US007320712B2

(12) United States Patent
Suh

(10) Patent No.: US 7,320,712 B2
(45) Date of Patent: Jan. 22, 2008

(54) METHOD FOR BLOCKING DYE-MIGRATION IN PRINTING COLORED SYNTHETIC FIBER

(76) Inventor: Chung Kil Suh, No. 304-705, Sungwon Apartment, 193, Taejun-dong, Kwangju-si, Kyunggi-do (KR)

( * ) Notice: Subject to any disclaimer, the term of this patent is extended or adjusted under 35 U.S.C. 154(b) by 417 days.

(21) Appl. No.: 10/944,703

(22) Filed: Sep. 21, 2004

(65) Prior Publication Data

US 2005/0108834 A1 May 26, 2005

(30) Foreign Application Priority Data

Nov. 20, 2003 (KR) ..... 10-2003-0082525

(51) Int. Cl.
*D06P 5/24* (2006.01)

(52) U.S. Cl. ..... 8/445; 8/467

(58) Field of Classification Search ..... 8/467, 8/445
See application file for complete search history.

(56) References Cited

U.S. PATENT DOCUMENTS 3,684,545 A * 8/1972 Worrall ..... 428/202
5,504,559 A * 4/1996 Ojima et al. ..... 430/123.41

FOREIGN PATENT DOCUMENTS

JP 55156085 * 12/1980
JP 7-31698 A 12/1995
JP 3022291 U 12/1995
JP 07316982 * 12/1995

* cited by examiner

*Primary Examiner*—Lorna M. Douyon
*Assistant Examiner*—Amina Khan
(74) *Attorney, Agent, or Firm*—Sughrue Mion, PLLC

(57) ABSTRACT

The present invention provides a method for blocking dye-migration in printing onto colored synthetic fiber and a printing process onto colored synthetic fiber using the method. More particularly, the present invention provides a composition for blocking dye-migration in printing on colored synthetic fiber containing activated carbon as an active ingredient and provides a transfer paper comprising a resin layer containing activated carbon to block dyes in the synthetic fiber from migration.

1 Claim, 2 Drawing Sheets

Printed product of the present invention

Printed product of the present invention

Printed product of the conventional art

METHOD FOR BLOCKING DYE-MIGRATION IN PRINTING COLORED SYNTHETIC FIBER

FIELD OF THE INVENTION

The present invention relates to a method for blocking dye-migration in printing onto colored synthetic fiber and to a printing process onto colored synthetic fiber using the method. More particularly, the present invention relates to a composition for blocking dye-migration in printing onto colored synthetic fiber containing activated carbon as a blocking material, and to a transfer paper comprising a layer containing activated carbon for blocking dye in the synthetic fiber from migration.

BACKGROUND OF THE INVENTION

Generally, the term "synthetic fiber" means an artificial fiber made of synthetic polymer. Synthetic fibers include, but are not limited to, polyester fabric, polyacrylonitrile fabric, polyamide fabric, polyvinyl chloride fabric, polyurethane fabric, polyolefin fabric and polyfluoroethylene fabric, according to the kind of synthetic polymer. These fabrics are made by spinning fusion, solution or emulsion of polymers, and have thermo-plasticity, and are therefore easily melted at high temperature.

Synthetic fibers have slightly different properties according to the polymer used. However, in general, they have light specific gravity and high strengths in tension and friction, and are not easily wrinkled. In addition, they have chemical resistance and are not easily damaged by insects. However, they are inferior in absorptiveness, dyeing property and heat-resistance compared with natural fiber. Thus, it is necessary to pay special attention when treating them and printing something thereon.

When printing a desired object or design on synthetic fiber colored with disperse dye, dyes in the fiber may migrate and be mixed with the ink composition printed thereon, so that the resulting print may be spread and distorted. For example, when printing a white picture onto black-colored fiber, the color of the picture may be changed to gray due to dye-migration.

FIG. 1 shows dye-migration occurring in the printed product, when printing a uniform number on colored synthetic fiber with a conventional method. It shows that the white uniform number was contaminated by the colored dye. On account of this, it is difficult to obtain the desired colors in printing or transcribing team marks or uniform numbers onto clothes such as athletic uniforms made of synthetic fiber, not cotton fabrics. As a result, adhesion of printed matter or embroidery has been applied instead of printing. In these cases, however, marks or numbers adhered onto the uniform may become cracked and cause poor feeling or heterogeneity, resulting in inconvenience.

Under these circumstances, in order to block a disperse dye in a synthetic fiber from migration causing blending thereof, the present inventor has studied extensively on the printing process onto colored synthetic fiber, and found that dye-migration can be blocked by pretreatment with a composition containing activated carbon or by incorporating activated carbon into a resin layer of a transfer paper or into an ink composition in printing on colored synthetic fiber. Based on this finding, the present invention has been completed.

SUMMARY OF THE INVENTION

Therefore, an object of the invention is to provide a method for blocking dye-migration in printing onto colored synthetic fiber, using activated carbon.

Another object of the present invention is to provide a printing process onto colored synthetic fiber, using the above method.

A further object of the present invention is to provide a composition containing activated carbon for blocking dye-migration in printing onto colored synthetic fiber.

A further object of the present invention is to provide a printing process onto colored synthetic fiber, using the above composition.

A further object of the present invention is to provide a transfer paper for colored synthetic fiber, comprising a resin layer containing activated carbon.

A further object of the present invention is to provide a printing process onto colored synthetic fiber, using the above transfer paper.

These and other objects and advantages of the present invention will become apparent to those skilled in the art from the following description together with the accompanying drawings.

DESCRIPTION OF REFERENCE NUMBERS IN THE DRAWINGS

Figure 1:
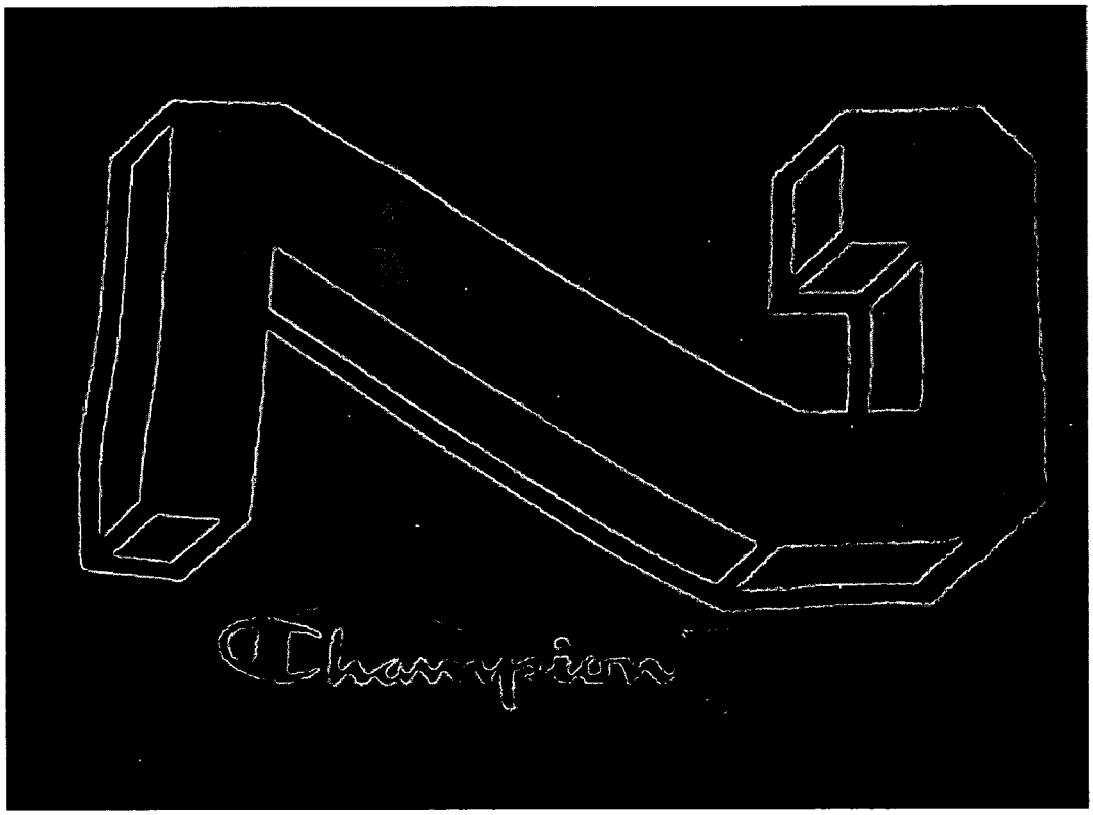
FIG. 1 is a photograph showing a printed product obtained by a conventional printing process.

| | |
|---|---|
| 10: Sheet | 20: Peel-off layer |
| 30: Printing layer | 40: Resin layer |
| 50: Adhesive layer | |

DETAILED DESCRIPTION OF THE INVENTION

The following is a detailed description of the present invention.

In order to achieve the above objects, the method of the present invention is characterized as using activated carbon for blocking dye-migration in printing onto colored synthetic fiber. In one embodiment, the present invention provides a composition for blocking dye-migration, wherein the activated carbon is incorporated into the composition for blocking dye-migration. In another embodiment for transfer paper, it may be incorporated into a resin layer of a transfer paper. In an additional embodiment, it may be incorporated into an ink composition.

Activated carbon employed in the present invention may be, as a powder, produced by high temperature activation of carbides such as wood, coconut shell, subbituminous coal (referred to as "brown coal"), bituminous coal and the like. It is an aggregate of amorphous carbon and acts as a nonpolar adsorbent having physical and chemical stability. Thus, it has been widely used in various industrial and environmental fields, for the purposes of decolorization, deodorization, refining or isolation of desired components.

Activated carbon is, in the first embodiment of the present invention, incorporated into a separate composition for blocking dye-migration. That is, the present invention provides a composition for blocking dye-migration in printing onto colored synthetic fiber, characterized in that it contains activated carbon as an active ingredient. In detail, the composition may comprise 40~60 parts of activated carbon, 100 parts of plasticizer, 0.5~1 parts of epoxy stabilizer, 5~6 parts of viscosifier and 2~5 parts of aerosol powder as an additive for film formation, to 100 parts by weight of PVC resin. In addition, it may have viscosity maintained within the range of 20,000~25,000 cps.

In this embodiment, the present invention may use, as a plasticizer, an admixture of DOP, DIDP, DBP and DOS, and more preferably, in the ratio of 3.2(DOP):4(DIDP): 1.5 (DBP):1(DOS) by weight, wherein DOP refers to dioctyl phthalate, DIDP to diisodecyl phthalate, DBP to dibutyl phthalate and DOS to dioctyl sebacate.

Further, the present invention provides a printing process onto colored synthetic fiber, characterized in that it comprises a pre-processing step of applying the composition on the region designated to be printed. Printing may then be performed by a conventional process such as silkscreen printing, using disperse dyes or pigments.

In the second embodiment of the present invention, activated carbon is incorporated into a resin layer of a transfer paper. That is, the present invention provides a transfer paper for colored synthetic fiber, characterized in that it comprises a resin layer containing activated carbon. A transfer paper may be, but is not limited to, preferably be produced in a form of a cutting sheet.

Figure 2:
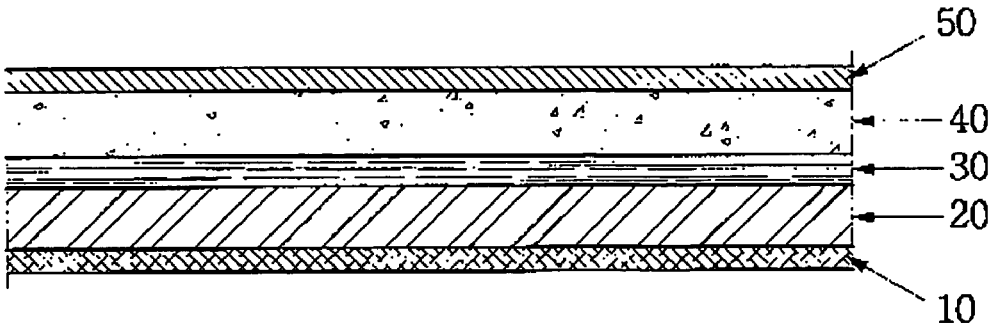
FIG. 2 is a cross-sectional view of a transfer paper for colored synthetic fiber according to the present invention.
Figure 3:
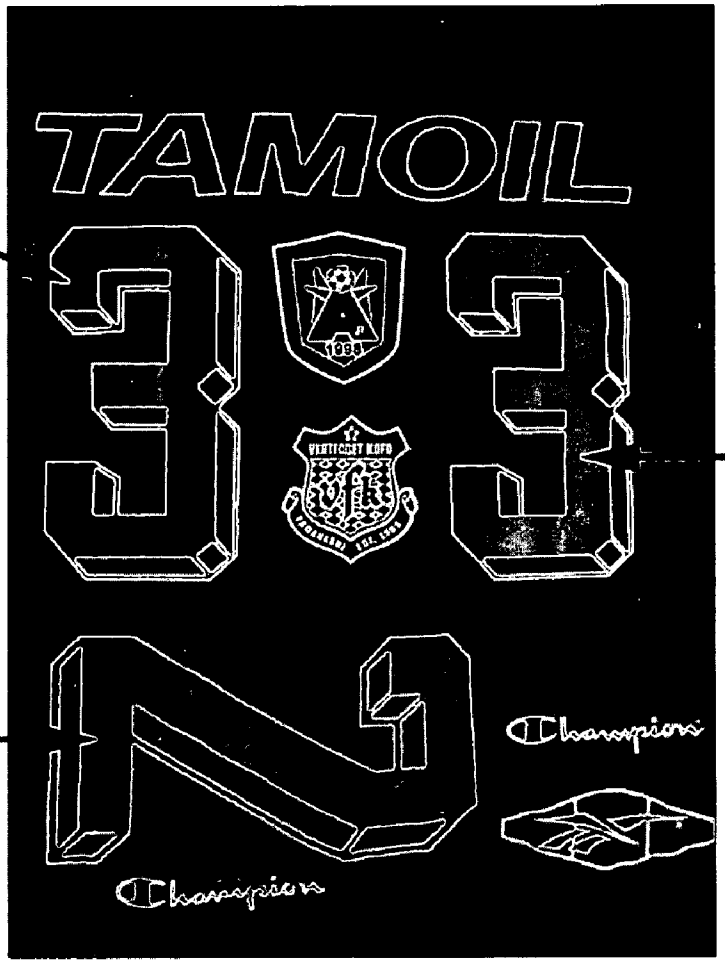
FIG. 3 is a photograph showing a printed product obtained by a printing process of the present invention and a printed product obtained by a printing process of a conventional method, in order for comparison with each other.

In detail, the transfer paper may comprise a sheet (10), a peel-off layer (20), a printing layer (30), a resin layer (40) and an adhesive layer (50), in order from the bottom, as shown in FIG. 2.

The sheet (10) may be paper, polyethylene film, polypropylene film, polyvinyl chloride sheet or polystyrene film.

The peel-off layer (20) may be formed on the sheet (10) by applying silicone or wax in a thickness of 0.1~1.0 μm with a gravure roll coating system, expert roll coating system, or sheet-fed offset printing process.

The printing layer (30) may be formed on the peel-off layer (20) by applying a printing composition in a thickness of approximate 30 μm and then drying. The printing composition may comprise 30~50 parts of polyurethane resin, 10~50 parts of pigments and 1~5 parts of additives, to 100 parts by weight of a solvent. The additives employed herein may include, but are not limited to, common viscosifier, stabilizer, antifoaming agent or the like. As a viscosifier, aerosol or silica may be preferably employed, but it is not limited thereto. Also, as a stabilizer, isophorone, and as an antifoaming agent, silicone, may be preferably employed, but they are not limited thereto.

The resin layer (40) may be formed on the printing layer (30) by applying a resin composition in a thickness of approximate 30 μm with a silkscreen printing process and then drying. The resin composition may comprise 30~50 parts of polyurethane resin, 10~50 parts of activated carbon and 1~5 parts of additives, to 100 parts by weight of a solvent. The additives employed herein may include, but are not limited to, common viscosifier, stabilizer, antifoaming agent or the like.

The solvents employed in the printing layer (30) and in the resin layer (40) may be, but are not limited to, toluene, methyl ethyl ketone (MEK), ethyl acetate or the like.

The adhesive layer (50) may be formed on the resin layer (40) by applying an adhesive composition in a thickness of 20~30 μm. The adhesive composition may comprise 50~70 parts of ethylene vinyl acetate(EVA), 25~35 parts of copolymer of vinyl chloride and isobutylvinyl ester (prex), 15~20 parts of vinyl resin(VAGH), 20~30 parts of urethane adhesive and 20~30 parts of hot-melt adhesive, to 100 parts by weight of a solvent, and be produced by thermopolymerization thereof at 80° C. for 3 hours. The adhesive composition employed herein has good miscibility between the resin layer and the fiber and strong adhesive force, so as to maintain the tensile force resistance of the urethane resin.

The transfer paper produced above may be used in printing a mark or a pattern onto an athletic uniform of colored synthetic fiber. Further, the present invention provides a printing process onto colored synthetic fiber, characterized in that it comprises a step of putting the transfer paper on the fiber and then pressing at 140~160° C., 4~5 kgf/cm$^2$ for 15~20 seconds.

Additionally, in the third embodiment of the present invention, activated carbon is incorporated into an ink composition. That is, the present invention provides an ink composition for colored synthetic fiber, characterized in that it comprises activated carbon. In detail, activated carbon may be incorporated into common printing ink in an amount of 20~30% by weight based on the total weight of ink composition. Further, the present invention provides a printing process onto colored synthetic fiber, using the ink composition.

In any case, the present invention can block disperse dye in a colored synthetic fiber from migrating and thereby prevent the printed product from being contaminated, so as to obtain clear printing colors.

Preffered Embodiment of the Invention

The present invention will be described in more detail with reference to the following examples. However, these examples are provided for the purpose of illustration only and should not be construed as limiting the scope of the invention.

EXAMPLE 1

Printing Process onto Colored Synthetic Fiber, Using a Composition for Blocking Dye-Migration A composition for blocking dye-migration was produced by mixing 40 parts of activated carbon, 100 parts of plasticizer (DOP:DIDP:DBP:DOS=3.2:4:1.5:1), 1 part of epoxy stabilizer, 5 parts of viscosifier (VS1025) and 3 parts of aerosol powder, to 100 parts by weight of PVC resin. The obtained composition had a viscosity of 20,000~25,000 cps.

The obtained composition was applied in the thickness of 20 μm onto the colored polyester fabric. Printing was then performed according to the conventional process using water-soluble binder ink.

EXAMPLE 2

Printing Process onto Colored Synthetic Fiber, Using a Transfer Paper for Synthetic Fiber A peel-off layer (20) was formed on a paper sheet (10) by applying silicone in the thickness of 0.5 μm, with the gravure roll coating system. On the peel-off layer (20), a printing composition was applied in the thickness of 30 μm and then dried, to form a printing layer (30). The printing composition was composed of 40 parts of polyurethane resin, 25 parts of pigments and 3 parts of additives, to 100 parts by weight of methyl ethyl ketone.

On the printing layer (30), a resin composition was applied in the thickness of 30 μm, to form a resin layer (40). The resin composition was composed of 40 parts of polyurethane resin, 25 parts of activated carbon and 3 parts of additives, to 100 parts by weight of methyl ethyl ketone.

On the resin layer (40), an adhesive composition was applied in a thickness of 20□, to form an adhesive layer (50) and to produce a transfer paper for synthetic fiber. The adhesive composition was composed of 60 parts of ethylene vinyl acetate(EVA), 30 parts of lanoprex, 15 parts of vinyl resin(VAGH), 20 parts of urethane adhesive and 20 parts of hot-melt adhesive, to 100 parts by weight of a solvent, and was produced by thermopolymerization thereof at 80° C. for 3 hours.

The transfer paper produced above was put on the colored polyester fabric and pressed at 150° C., 4 kgf/cm$^2$ for 15 seconds. The upper sheet was then peeled off.

Although this invention has been described with respect to specific embodiments, the details of these embodiments are not to be construed as limitations. Various equivalents, changes and modifications may be made within the spirit and scope of this invention, and it is understood that such equivalent embodiments are part of this invention.

As above described, dye-migration in printing onto colored synthetic fiber can be blocked by pretreatment with a composition containing activated carbon, or by incorporating activated carbon into a resin layer of a transfer paper or into an ink composition. Accordingly, the present invention can block dye-migration effectively by comprising a preprocessing step of coating with the composition, or by using the transfer paper or ink composition, and thereby prevent the printed product from being contaminated, so as to obtain clear colors.

What is claimed is:

1. A method of printing on a colored synthetic fiber, which comprises providing a composition comprising an activated carbon which blocks migration of a dye;

applying the composition on a position of the fiber to be printed; and applying pressure to allow the composition to be fixed to the fiber, wherein the composition comprises 40-60 parts of activated carbon, 100 parts of plasticizer, 0.5-1 parts of epoxy stabilizer, 5-6 parts of viscosifler and 2-5 parts of aerosol powder as an additive for film formation, to 100 parts by weight of PVC resin and has viscosity maintained within the range of 20,000-25,000 cps.

* * * * *